US009767785B2

(12) United States Patent
Ashby et al.

(10) Patent No.: US 9,767,785 B2
(45) Date of Patent: Sep. 19, 2017

(54) NOISE CANCELLING MECHANISM IN A TREADMILL

(71) Applicant: ICON Health & Fitness, Inc., Logan, UT (US)

(72) Inventors: Darren C. Ashby, Richmond, UT (US); Eric Watterson, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 0 days.

(21) Appl. No.: 14/744,370

(22) Filed: Jun. 19, 2015

(65) Prior Publication Data

US 2015/0367169 A1 Dec. 24, 2015

Related U.S. Application Data

(60) Provisional application No. 62/015,224, filed on Jun. 20, 2014.

(51) Int. Cl.

| | |
|---|---|
| ***A63B 22/00*** | (2006.01) |
| ***G10K 11/178*** | (2006.01) |
| ***A63B 22/02*** | (2006.01) |
| ***A63B 24/00*** | (2006.01) |
| *A63B 71/06* | (2006.01) |

(52) U.S. Cl.

CPC ..... *G10K 11/178* (2013.01); *A63B 22/0242* (2013.01); *A63B 24/0062* (2013.01); *A63B 24/0087* (2013.01); *G10K 11/1788* (2013.01); *A63B 2024/009* (2013.01); *A63B 2024/0068* (2013.01); *A63B 2024/0071* (2013.01); *A63B 2071/063* (2013.01); *A63B 2071/065* (2013.01); *A63B 2071/0625* (2013.01); *A63B 2230/06* (2013.01); *A63B 2230/75* (2013.01); *G10K 2210/105* (2013.01); *G10K 2210/121* (2013.01)

(58) Field of Classification Search

USPC ..... 482/1–148

See application file for complete search history.

(56) References Cited

U.S. PATENT DOCUMENTS

| | | | | |
|---|---|---|---|---|
| 8,824,697 | B2 * | 9/2014 | Christoph | H04R 3/005 381/122 |
| 2004/0114768 | A1 | 6/2004 | Luo et al. | |
| 2006/0205568 | A1 | 9/2006 | Huang | |
| 2007/0161466 | A1 | 7/2007 | Ogleby et al. | |
| 2012/0010053 | A1 | 1/2012 | Bayerlein et al. | |
| 2012/0230504 | A1 | 9/2012 | Kuroda | |

(Continued)

FOREIGN PATENT DOCUMENTS

| | | |
|---|---|---|
| EP | 0803860 A2 | 10/1997 |

OTHER PUBLICATIONS

International Search Report issued for PCT/US2015/036504 dated Sep. 30, 2015.

*Primary Examiner* — Stephen R Crow

(74) *Attorney, Agent, or Firm* — Holland & Hart LLP

(57) ABSTRACT

A treadmill having a running deck comprising a motor arranged to drive movement of a tread belt, a processor, memory in electronic communication with the processor, and instructions stored in the memory. The instructions are executable by the processor to determine an anti-phase waveform based on waveform attributes of a noise emitted from the treadmill and to cause a sound of the anti-phase waveform to be emitted into a surrounding environment.

20 Claims, 6 Drawing Sheets

(56) References Cited

U.S. PATENT DOCUMENTS

| | | | | |
|---|---|---|---|---|
| 2012/0242774 | A1* | 9/2012 | Numano | H04N 7/141<br>348/14.01 |
| 2015/0003621 | A1* | 1/2015 | Trammell | H04R 3/005<br>381/71.1 |
| 2015/0016623 | A1* | 1/2015 | Trammell | G10K 11/178<br>381/71.4 |

* cited by examiner

NOISE CANCELLING MECHANISM IN A TREADMILL

RELATED APPLICATIONS

This application claims priority to provisional Patent Application No. 62/015,224 filed Jun. 20, 2014, which application is hereby incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, and cycling among others activities. In contrast, anaerobic exercise often involves high intensity exercises over a short duration of time. Popular forms of anaerobic exercise include strength training and short distance running.

Many choose to perform aerobic exercises indoors, such as in a gym or their home. Often, a user will use an aerobic exercise machine to have an aerobic workout indoors. One such type of aerobic exercise machine is a treadmill, which is a machine that has a running deck attached to a support frame. The running deck can support the weight of a person using the machine. The running deck incorporates a conveyor belt that is driven by a motor. A user can run or walk in place on the conveyor belt by running or walking at the conveyor belt's speed. The speed and other operations of the treadmill are generally controlled through a control console that is also attached to the support frame and within a convenient reach of the user. The control console can include a display, buttons for increasing or decreasing a speed of the conveyor belt, controls for adjusting a tilt angle of the running deck, or other controls. Other popular exercise machines that allow a user to perform aerobic exercises indoors include ellipticals, rowing machines, stepper machines, and stationary bikes to name a few.

One type of treadmill is disclosed in U.S. Patent Publication No. 2006/0205568 issued to Ping-hui Huang. In this reference, an improved treadmill is provided that includes a base frame, a platform and an endless belt. The treadmill in accordance with the invention is characterized in that the platform includes a cushioning pad with a thickness ranging from 1 to 10 mm and is stuck to a top surface thereof, and that a smooth wear-resisting layer is attached to a top surface of the cushioning pad in such a manner that the wear-resisting layer and the cushioning pad are fitted to form a whole and the wear-resisting layer is interposed between the endless belt and the cushioning pad for providing more comfort and reducing the exercise injuries to a minimal extent.

SUMMARY

In one aspect of the disclosure, a treadmill includes a running deck comprising a motor arranged to drive movement of a tread belt.

In one or more other aspects that may be combined with any of the aspects herein, may further include a processor and memory in electronic communication with the processor.

In one or more other aspects that may be combined with any of the aspects herein, may further include instructions stored in the memory.

In one or more other aspects that may be combined with any of the aspects herein, may further include that the instructions are executable by the processor to determine an anti-phase waveform based on waveform attributes of a sound emitted from the treadmill.

In one or more other aspects that may be combined with any of the aspects herein, may further include that the instructions are executable by the processor to cause a sound of the anti-phase waveform to be emitted into a surrounding environment.

In one or more other aspects that may be combined with any of the aspects herein, may further include that the noise is a motor noise.

In one or more other aspects that may be combined with any of the aspects herein, may further include that the noise is generated by a user exercising on the running deck.

In one or more other aspects that may be combined with any of the aspects herein, may further include a microphone incorporated into the treadmill.

In one or more other aspects that may be combined with any of the aspects herein, may further include that the microphone is incorporated into the running deck of the treadmill.

In one or more other aspects that may be combined with any of the aspects herein, may further include that the instructions are further executable by the processor to emit the sound of the anti-phase waveform with a speaker incorporated into the treadmill.

In one or more other aspects that may be combined with any of the aspects herein, may further include that the sound of the anti-phase waveform is emitted in the surrounding environment with a speaker that is incorporated into the running deck of the treadmill.

In one or more other aspects that may be combined with any of the aspects herein, may further include that the instructions are further executable by the processor to determine the waveform attributes.

In one or more other aspects that may be combined with any of the aspects herein, may further include that the instructions are further executable by the processor to receive the waveform attributes from an independent device.

In one or more other aspects that may be combined with any of the aspects herein, may further include that the instructions are further executable by the processor to distinguish between motor noise and other types of sounds from the treadmill.

In one or more other aspects that may be combined with any of the aspects herein, may further include that the instructions are further executable by the processor to generate the sound of the anti-phase waveform to cancel the motor noise.

In one or more other aspects that may be combined with any of the aspects herein, may further include that the sound of the anti-phase waveform has an effect of reducing the volume of the noise.

In one or more other aspects that may be combined with any of the aspects herein, may further include that the sound of the anti-phase waveform has an effect of cancelling the noise.

In one or more other aspects that may be combined with any of the aspects herein, may further include a treadmill having a running deck comprising a motor arranged to drive movement of a tread belt.

In one or more other aspects that may be combined with any of the aspects herein, may further include a microphone incorporated into the treadmill.

In one or more other aspects that may be combined with any of the aspects herein, may further include a processor and memory in electronic communication with the processor.

In one or more other aspects that may be combined with any of the aspects herein, may further include instructions stored in the memory.

In one or more other aspects that may be combined with any of the aspects herein, may further include that the instructions are executable by the processor to determine the waveform attributes of a noise emitted from the treadmill and recorded with the microphone.

In one or more other aspects that may be combined with any of the aspects herein, may further include that the instructions are executable by the processor to generate an anti-phase waveform based on waveform attributes.

In one or more other aspects that may be combined with any of the aspects herein, may further include that that instructions are executable by the processor to cause a sound of the anti-phase waveform to be emitted into a surrounding environment with a speaker incorporated into the treadmill.

In one or more other aspects that may be combined with any of the aspects herein, may further include that the microphone is incorporated into the running deck of the treadmill.

In one or more other aspects that may be combined with any of the aspects herein, may further include the sound of the anti-phase waveform is directed at a component of the treadmill.

In one or more other aspects that may be combined with any of the aspects herein, may further include that the speaker is incorporated into the running deck of the treadmill.

In one or more other aspects that may be combined with any of the aspects herein, may further include that the instructions are further executable by the processor to distinguish between motor noise and other types of sounds from the treadmill.

In one or more other aspects that may be combined with any of the aspects herein, may further include the instructions are further executable by the processor to generate the sound of the anti-phase waveform to cancel the motor noise.

In one or more other aspects that may be combined with any of the aspects herein, may further include a treadmill having a running deck comprising a motor arranged to drive movement of a tread belt.

In one or more other aspects that may be combined with any of the aspects herein, may further include a microphone incorporated into the running deck.

In one or more other aspects that may be combined with any of the aspects herein, may further include a speaker incorporated into the treadmill.

In one or more other aspects that may be combined with any of the aspects herein, may further include a processor and memory in electronic communication with the processor.

In one or more other aspects that may be combined with any of the aspects herein, may further include instructions stored in the memory.

In one or more other aspects that may be combined with any of the aspects herein, may further include that the instructions are executable by the processor to distinguish between motor noise and other types of sounds from the treadmill recorded with the microphone.

In one or more other aspects that may be combined with any of the aspects herein, may further include that the instructions are executable by the processor to determine the waveform attributes of the motor noise.

In one or more other aspects that may be combined with any of the aspects herein, may further include that the instructions are executable by the processor to generate an anti-phase waveform based on waveform attributes.

In one or more other aspects that may be combined with any of the aspects herein, may further include that the instructions are executable by the processor to cause a sound of the anti-phase waveform to be emitted into a surrounding environment with the speaker.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

Some commercially available treadmills include a motor that causes the tread belt to move. Often, these motors produce noise, which can cause the operation of the treadmill to be noisy. The principles described herein include a treadmill with a noise control system. Such a system includes the ability to reduce and/or cancel the noise coming from the motor. In other examples, the treadmill includes the ability to reduce and/or cancel other types of noises emanating from the treadmill.

Figure 1:
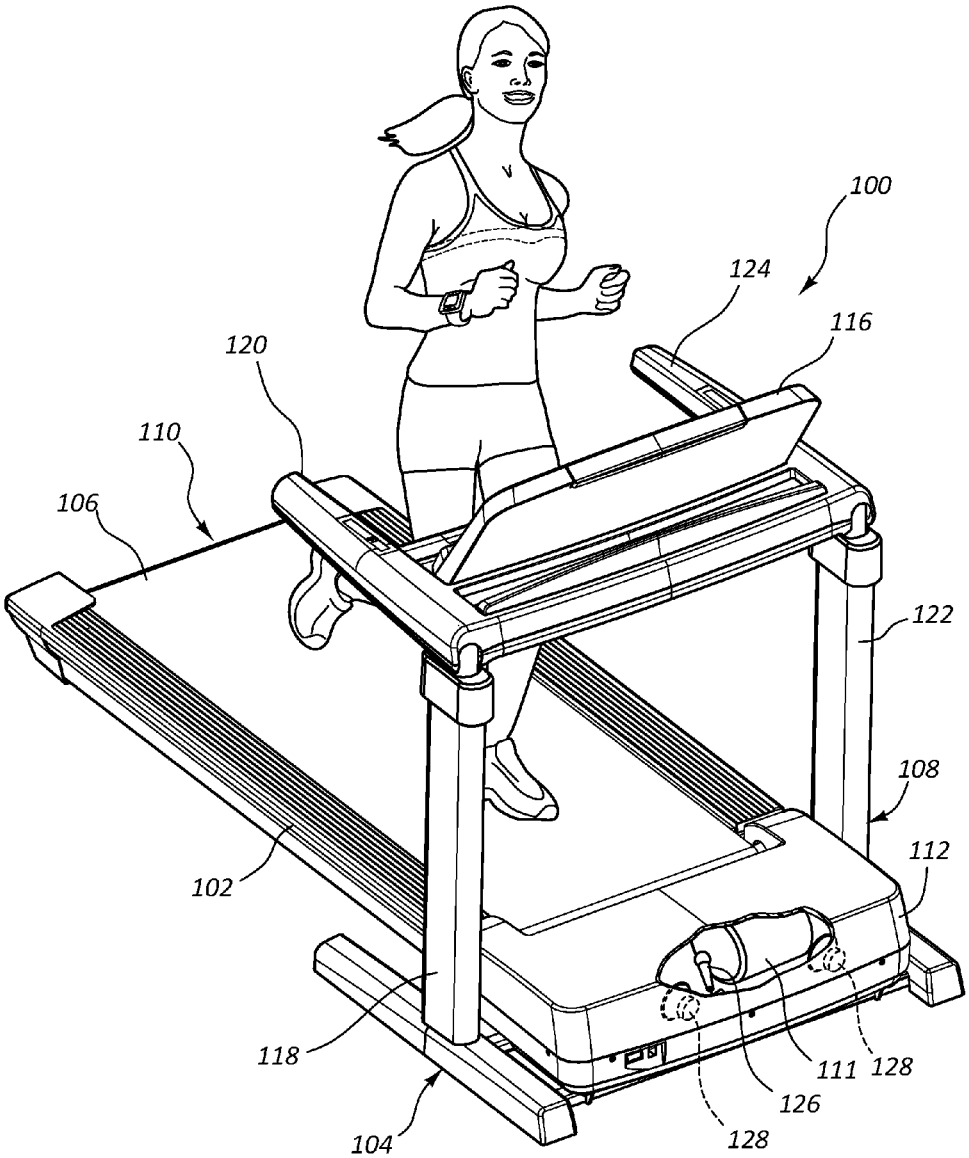
FIG. 1 illustrates a perspective view of an example of a treadmill in accordance with the present disclosure.

Particularly, with reference to the figures, FIG. 1 depict a treadmill 100. The treadmill 100 includes a running deck 102 that can support the weight of a user and that is attached to a frame 104. The running deck 102 incorporates a tread belt 106 that extends from a first pulley at a first location 108 to a second pulley at a second location 110. The underside of the tread belt's mid-section is supported by a low friction surface that allows the tread belt's underside to move along the mid-section's length without creating significant drag. The tread belt 106 is moved by a motor 111 that is connected to the first pulley and is disposed within a housing 112 formed in a front portion of the running deck 102. As the tread belt 106 moves, a user positioned on the tread belt 106 can walk or run in place by keeping up with the tread belt's speed.

A control console 116 is also supported by the frame 104. In the example of FIG. 1, a first frame post 118 positions a first hand hold 120 near the control console 116, and a second frame post 122 positions a second hand hold 124 near the control console 116 such that a user can support himself or herself during exercise by grasping the hand holds 120, 124. The control console 116 allows the user to perform a predetermined task while simultaneously operating an exercise mechanism of the treadmill 100 such as control parameters of the running deck 102. For example, the control console may include controls to adjust the speed of the tread belt 106, adjust a volume of a speaker integrated into the treadmill 100, adjust an incline angle of the running deck 102, adjust a decline of the running deck 102, select an exercise setting, control a timer, change a view on a display of the control console 116, monitor the user's heart rate or other physiological parameters during the workout, perform other tasks, or combinations thereof. Buttons, levers, touch screens, voice commands, or other mechanisms may be incorporated into the control console 116 incorporated into the treadmill 100 and can be used to control the capabilities mentioned above. Information relating to these functions may be presented to the user through the display. For example, a calorie count, a timer, a distance, a selected program, an incline angle, a decline angle, another type of information, or combinations thereof may be presented to the user through the display.

In the example of FIG. 1, the motor 111 causes the first pulley to rotate, which causes the upper portion of the tread belt 106 to be pulled towards the motor. The forces on the upper portion of the tread belt 106 in turn cause the rotation of the second pulley. Likewise, the rotation of the second pulley causes the under portion of the tread belt 106 to be pulled towards the second pulley. In this manner, the tread belt 106 moves when driven by the motor.

The sounds produced by the treadmill 100 when the tread belt 106 is moving include the sounds produced by the motor, the sounds produced by the rotation of the first pulley, the sounds produced by the rotation of the second pulley, and the sounds of the upper portion of the tread belt 106 moving across the surface of the running deck's mid-section. In other examples, other sounds may be produced in conjunction with the movement of the tread belt 106. Additional noise may be produced when a user is walking or running on the tread belt 106 as the tread belt 106 moves.

Any of these noises, collectively or in isolation, may have undesirable effects on the user or others located nearby. For example, one of the above mentioned noises may cause the user difficulty when listening to his or her music or entertainment. As a result, the user may have to increase the volume of his or her entertainment to hear it over the treadmill's noise. In situations where the user turns up the volume of his or her entertainment, the noise level in the room becomes even louder. In another example, the loudness of these noises bothers the user making usage of the treadmill 100 less desirable to him or her. In yet another example, a person nearby the operating treadmill 100 may become frustrated due to the noise, which may cause that person to leave the area.

The noise from the treadmill 100 may be reduced and/or cancelled with a noise control system incorporated into the treadmill 100. Such a noise control system may include at least one microphone 126, processing resources, and at least one speaker 128. The microphone 126 may detect the noise emanating from the treadmill 100. Such a microphone 126 may be incorporated into the treadmill's housing, incorporated into the treadmill's frame, internal to the treadmill's housing, incorporated into the treadmill's control console, positioned elsewhere on the treadmill 100, positioned nearby the treadmill 100, attached to the treadmill in another location suitable for detecting the treadmill's noise, or combinations thereof.

The microphone 126 may be a dynamic microphone with a lightweight diaphragm attached to a coil of wire suspended in a permanent magnetic field. In such an example, the diaphragm can be moved by the alternating pressures of the noise emanating from the treadmill 100. Movement of the diaphragm, in turn, moves the wire. As the wire moves within the magnetic field, an electrical current is produced that represents the characteristics of the treadmill's noise. In some situations, such a dynamic microphone has an amplifier to boost the electrical signal representing the noise's characteristics.

In other examples, a capacitive microphone is used to detect the treadmill's noise. Such a microphone may incorporate an electrical circuit with two parallel plates, one that moves in response to the noise's pressure waves and another plate that remains stationary. An electrical field is present between the parallel plates. As the noise's pressure waves moves the first plate, the distance between the first and second plates changes. As the distance of the plates change back and forth based on the alternating pressures of the treadmill's noise, the capacitance of the circuit also fluctuates, which produces a detectable alternating electrical current. As a result, an electrical signal is produced that represents the noise from the treadmill 100.

In some examples, the microphone 126 is configured to pick up sounds equally from all angles. In such an example, the microphone 126 can pick up the sounds from each of the various components of the treadmill 100 that make noise during their operation. In other examples, the microphone 126 is focused towards picking up sounds from specific angles. In such an example, the microphone 126 may be positioned to pick up sounds from specific components of the treadmill 100, such as the motor 111. Thus, in situations where the motor 111 or other treadmill component is a predominate noise making component of the treadmill 100, the microphone 126 can be arranged to single out sounds from the motor or other treadmill component. While the examples above have been described with reference to specific types of microphones and specific features of the microphones, any appropriate type of microphone or any appropriate microphone feature may be incorporated into the principles described in the present disclosure.

The microphone 126 may send the signals representing the detected noise to the processing resources. In some examples, the microphone 126 sends the signals in an analog format. However, in other examples, the microphone 136 sends the signals in n digital format. In such an example, an analog/digital converter may be used for generate the digital signal. The processing resources can receive the signals and determine the noise's waveform characteristics. In some examples, the signal represents a number of sounds from different sources. Each of such sources may produce sounds with different waveform characteristics. For examples, sounds from the rotation of the first pulley and sounds from the motor may be represented in a single signal and sent to the processing resources. The processing resources may have the capability of detecting each type of sound represented in the signal. Thus, in continuing with the example above, the processing resources may be able to distinguish between the sounds from the pulleys and the sounds from the motor.

Based on the analysis of the sound's waveform or waveforms, the processing resources can cause an anti-phase waveform to be determined. Such an anti-phase waveform may be opposite of the treadmill sound's waveform. In other words, the anti-phase waveform may be 180 degrees out of phase with the waveform determined by the processing resources. In other examples, such an anti-phase waveform has at least some characteristics that are offset from the characteristics of the detected sound. In those examples where multiple sounds are detected, the processing resources create an anti-phase waveform that takes the different sound sources into consideration. For example, if the waveform determined by the processing resources includes sounds emanating from the treadmill as well as sounds that appear to be coming from the user's entertainment, the anti-phase waveform may be generated based on the waveforms from the treadmill's noise.

The determined anti-phase waveform may be stored locally in a buffer or another type of memory. The determined anti-phase waveform may be directed to the speaker 128 to be emitted into the environment surrounding the treadmill 100.

The determined anti-phase waveform exhibits the characteristics of at least reducing the volume of the sounds emanating from the treadmill 100. In some examples, the determined anti-phase waveform cancels the sounds emanating from the treadmill 100. In either situation, the noise emanating from the treadmill appears to the user and others to be quieter or eliminated.

Often, sounds traveling through the air exhibit alternating pressure levels. In such circumstances, when the sounds from the treadmill exhibit a high pressure, the sounds from the speakers (the anti-phase waveforms) may exhibit a corresponding low pressure. As a result, the pressures equalize and cancel the noise. In some examples, the anti-phase waveform's pressure cycle's may not be 180 degrees out of phase with the original waveform. However, in such an example, the noise from the treadmill may be at least reduced.

In some examples, the processing resources can distinguish between those sounds originating from the motor 111, the pulleys, the tread belt 106, or other portions of the treadmill 100. In such examples, sounds from music or entertainment played by the user can be ignored when determining the anti-phase waveform as described above. As a result, the sounds coming from the speakers will reduce or cancel just those sounds targeted by the processing resources, such as the noise emanating from the treadmill. As a result, user will still be able to hear the music and/or entertainment while using the treadmill 100 with the noise from the treadmill at least reduced or even cancelled. Often, the noises from the treadmill 100 exhibit long, repeatable wavelengths that can be distinguished from short duration, higher frequency sounds, such as music beats, lyrics, spoken words, other sounds, or combinations thereof. Thus, the processing resources may follow a policy for generating the anti-phase waveform on just those sounds that exhibit the longer repeatable wavelengths while excluding those wavelengths that appear to come from entertainment or sounds other than the treadmill's components.

The speakers 128 may be incorporated into the treadmill's housing, incorporated into the treadmill's frame, be internal to the treadmill's housing, incorporated into the treadmill's control console, positioned elsewhere on the treadmill 100, positioned nearby the treadmill 100, positioned at another location suitable for detecting the treadmill sounds, or combinations thereof. In some examples, the speakers 128 are placed next to the motor 111 or other noise source or sources on the treadmill. By placing the speakers 128 near the noise sources of the treadmill 100, the noises emanating from the treadmill 100 may be reduced or cancelled close to their source.

In some cases, the noise control system initially detects the sounds, records the sounds, and produces the anti-phase waveform without continuously monitoring for changes in the treadmill's noise. In such an situation, the treadmill's noises may be consistent over time, and the anti-phase waveform may not need to be modified. However, in other cases, the microphone 126 continuously monitors the sounds emanating from the treadmill 100 through the microphone 126 and sends signals to the processing resources. As the processing resources detect changes in the treadmill's noise, the processing resources may cause the anti-phase waveform to change to reflect the changed sound waves. Thus, sounds of the anti-phase waveform are emitted into the environment surrounding the treadmill 100 that more effectively cancel or reduce the treadmill's noise.

Figure 2:
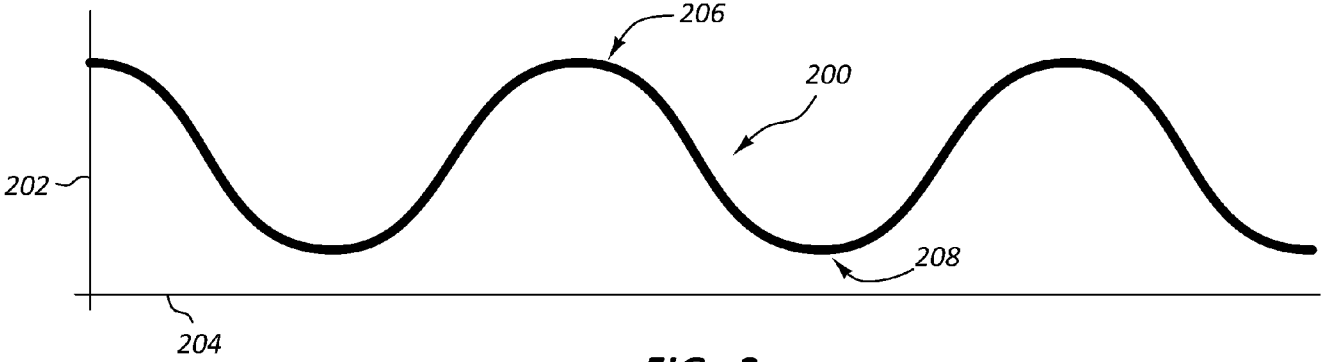
FIG. 2 illustrates a diagram of an example of a sound waveform emitted by a treadmill in accordance with the present disclosure.

FIG. 2 depicts a representation of an example of a waveform 200 of sound emanating from the treadmill 100. In this example, the vertical axis 202 represents a level of compression of air molecules while the horizontal axis 204 represents time. Accordingly, a crest 206 in the waveform 200 represents a higher compression while a trough 208 in the waveform 200 represents a lower compression. Thus, over time the sounds emanating from the treadmill 100 alternatingly exhibit higher compression and lower compression of air molecules.

Figure 3:
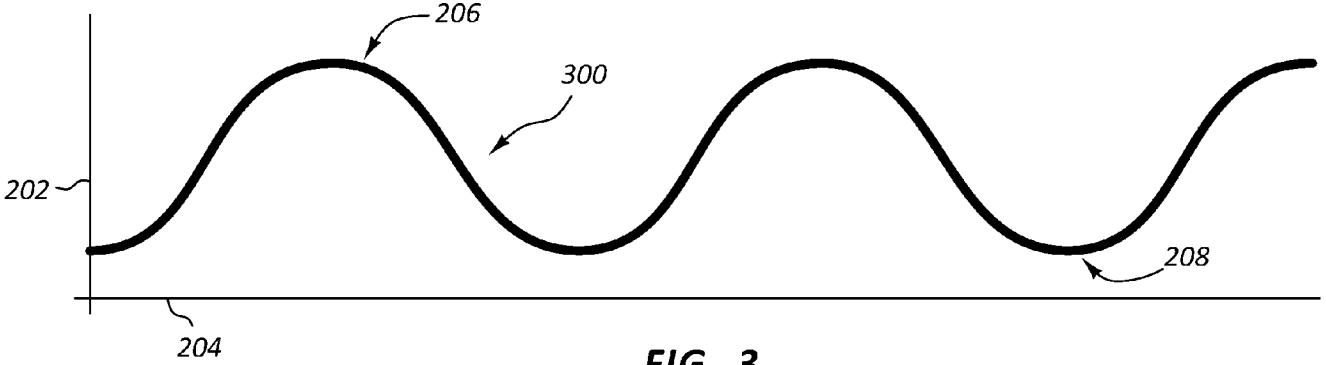
FIG. 3 illustrates a diagram of an example of an anti-phase waveform to the waveform of FIG. 2.

FIG. 3 depicts a representation of an example of an anti-phase waveform 300 of the waveform depicted in FIG. 2. In this example, the vertical axis 202 represents a level of compression of air molecules while the horizontal axis 204 represents time. Accordingly, a crest 206 in the waveform 200 represents a higher compression while a trough 208 in the waveform 200 represents a lower compression. The anti-phase waveform is 180 degrees off phase of the waveform 200 in the example of FIG. 2.

Figure 4:
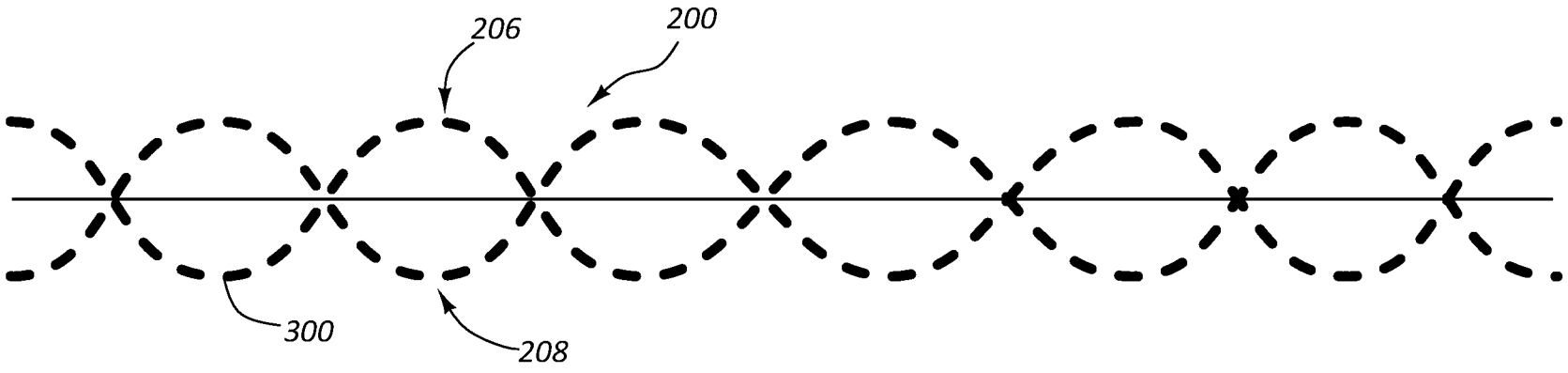
FIG. 4 illustrates a diagram of an example of noise cancellation in accordance with the present disclosure.

FIG. 4 depicts a representation of an example of the waveform of FIG. 2 superimposed with the anti-phase waveform 300 of FIG. 3 to represent both the waveform 200 and the anti-phase waveform 300 being emitted into the environment surrounding the treadmill 100. In this example, crests 206 of the waveform 200 occur at the same point in time as the troughs 208 of the anti-phase waveform 300. Likewise, the troughs 208 of the waveform 200 occur at the same point in time as the crests 206 of the anti-phase waveform 300. As a result, the combination of the waveform 200 and the anti-phase waveform 300 cancel each other out resulting in no air compression changes and no sound.

Figure 5:
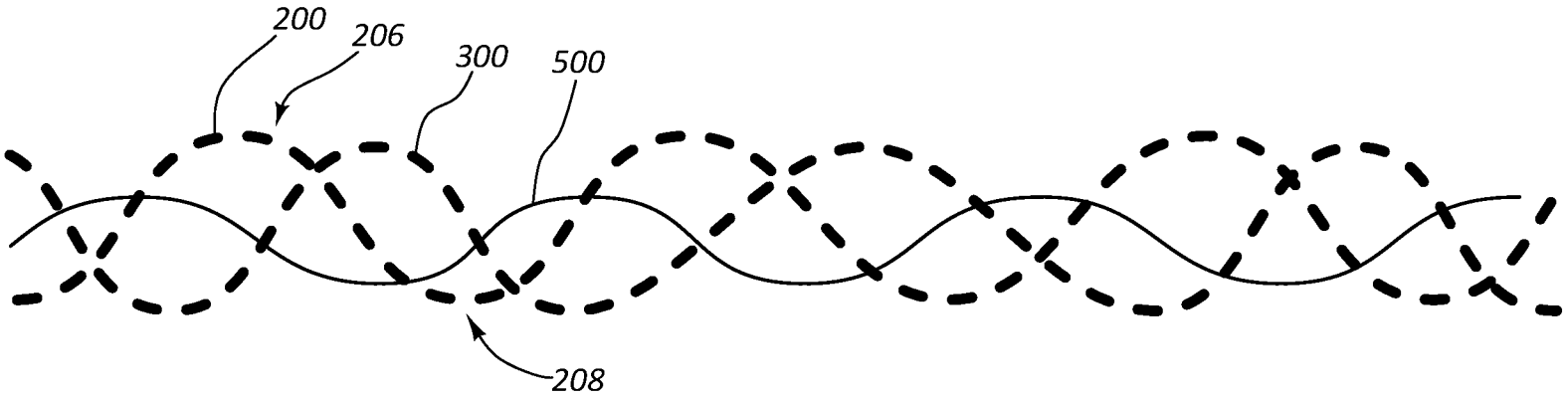
FIG. 5 illustrates a diagram of an example of noise reduction in accordance with the present disclosure.

FIG. 5 depicts a representation of an example of the waveform of FIG. 2 superimposed with the anti-phase waveform 300 of FIG. 3 to represent both the waveform 200 and the anti-phase waveform 300 being emitted into the environment surrounding the treadmill 100. In this example, crests 206 of the waveform 200 occur at a different point in time as the troughs 208 of the anti-phase waveform 300. Likewise, the troughs 208 of the waveform 200 occur at a different point in time as the crests 206 of the anti-phase waveform 300. As a result, the combination of the sounds of the waveform 200 and the anti-phase waveform 300 do not cancel each other out as there is still resulting air compression changes being transmitted through the environment surrounding the treadmill 100. Consequently, a reduced waveform 500 results, which represents that some treadmill's noise can be detected. In such an example, the reduced waveform 500 has a smaller amplitude, which corresponds with a lower decibel level in the resulting sound. Thus, the resulting sound quieter than the original noise emanating from the treadmill 100.

The microphone 126 may still detect the reduced sound and send an appropriate signal to the processing resources. In such a situation, the processing resources may adjust the anti-phase waveform 300 to change its phase to be completely 180 degrees off of the waveform 200 representing the original sound. Likewise, if the anti-phase waveform 300 has a different amplitude, a different crest value, a different trough value, another different waveform characteristic than the wave form 200, than the sound of the anti-phase waveform will not completely cancel out the original sound emanating from the treadmill. In some examples, the processing resources can make appropriate adjustments to anti-phase waveforms 300 that are do not entirely cancel out the treadmill's noise until the anti-phase waveform 300 adequately cancels out the treadmill's noise.

While the examples above depict the waveform 200 and anti-phase waveform 300 as having specific wavelengths, amplitudes, and other waveform characteristics, any appropriate type of sound with any appropriate waveform and anti-phase waveform characteristics may be used in accordance with the principles described in the present disclosure. For example, the wavelengths may be inconsistent from one waveform cycle to another, have inconsistent amplitudes, have other inconsistent features, have other features, or combinations thereof.

Figure 6:
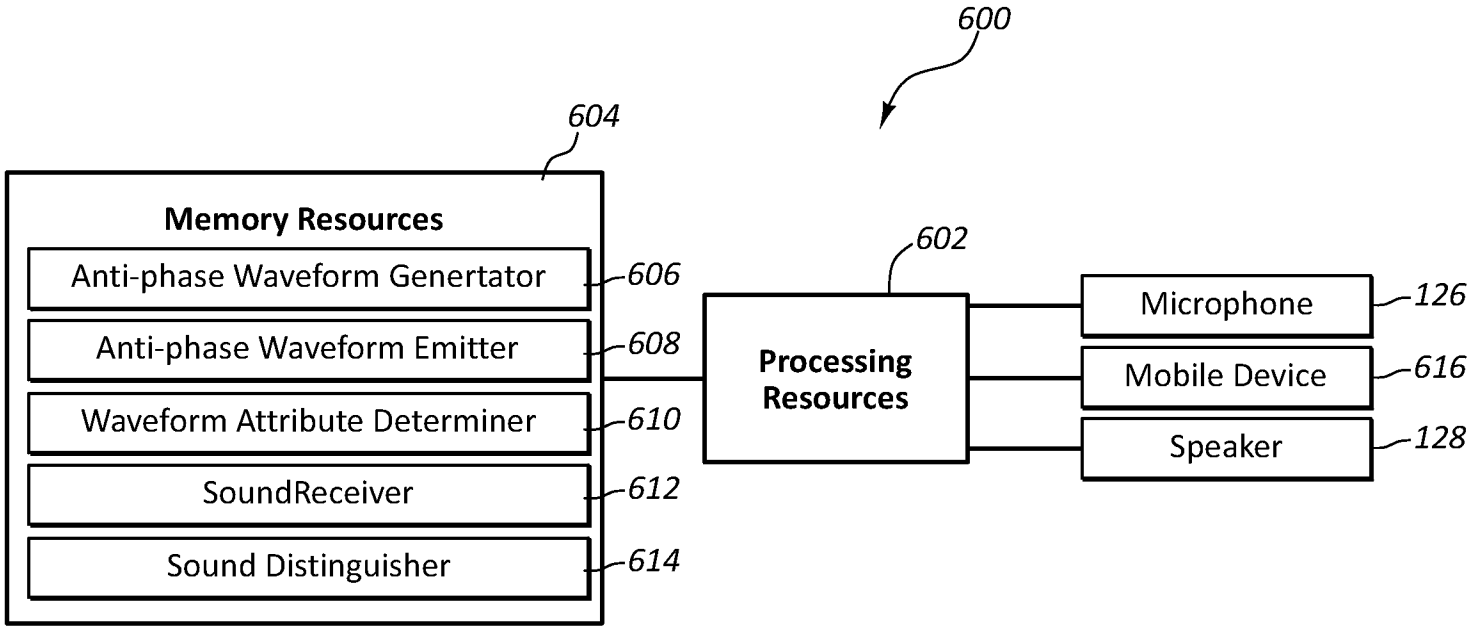
FIG. 6 illustrates a block diagram of an example of a noise control system in accordance with the present disclosure.

FIG. 6 illustrates a block diagram of an example of a noise control system 600 in accordance with the present disclosure. The noise control system 600 may include a combination of hardware and program instructions for executing the functions of the noise control system 600. In this example, the noise control system 600 includes processing resources 602 that are in communication with memory resources 604. Processing resources 602 include at least one processor and other resources used to process programmed instructions. The memory resources 604 represent generally any memory capable of storing data such as programmed instructions or data structures used by the noise control system 600. The programmed instructions stored in the memory resources 604 include an anti-phase waveform generator 606, an anti-phase waveform emitter 608, a waveform attribute determiner 610, a sound receiver 612, and a sound distinguisher 614.

The memory resources 604 include a computer readable storage medium that contains computer readable program code to cause tasks to be executed by the processing resources 602. The computer readable storage medium may be a tangible and/or non-transitory storage medium. The computer readable storage medium may be any appropriate storage medium that is not a transmission storage medium. A non-exhaustive list of computer readable storage medium types includes non-volatile memory, volatile memory, random access memory, write only memory, flash memory, electrically erasable program read only memory, magnetic based memory, other types of memory, or combinations thereof.

The sound receiver 612 represents programmed instructions that, when executed, cause the processing resources 602 to receiver the sound from the microphone 126. In other examples, the sounds may be received through a mobile device 616 carried by the user, and the sounds may be sent from the mobile device 616 to the sound receiver 612. The sound receiver 612 may receive the sound in a digital format, an analog format, another type of format, or combinations thereof. The waveform attribute determiner 610 represents programmed instructions that, when executed, cause the processing resources 602 to determine the attributes of the sound's waveform. Such attributes may include features such as the sound's frequency of alternating sound pressures, the amplitude of alternating sounds pressures, the decibel level of the sound, other features of the sound, or combinations thereof.

Further, the sound distinguisher 614 represents programmed instructions that, when executed, cause the processing resources 602 to distinguish between certain types of sounds. For example, it may be desirable to cancel or reduce sounds emanating from the treadmill's motor, pulleys, other treadmill components, or combinations thereof. On the other hand, it may not be desirable to cancel or reduce sounds such as people talking, entertainment, music, other types of sounds, or combinations thereof. The sound distinguisher 614 may determine which of the sounds are received by the sound receiver 612 should be cancelled or reduced. Factors that the sound distinguisher 614 may consider when determining which sounds to cancel and/or reduce include the consistency of the sound, the pitch of the sound, the loudness of the sound, other features of the sound, or combinations thereof. Often, the sounds emanating from the treadmill's motor, which may be desirable to cancel or reduce, are consistent over time and exhibit long wavelength characteristics. On the other hand, sounds associated with talking, music, or entertainment, which may not be desirable to cancel or reduce, may include inconsistent sounds over time and often have a higher pitch. Thus, the sound distinguisher 614 may use policies that reflect such characteristics when determining which sounds to cancel and/or reduce.

The anti-phase waveform generator 606 represents programmed instructions that, when executed, cause the processing resources 602 to construct a cancelling or reducing sound that reflects a waveform representing the sounds from the treadmill, but are 180 degrees out of phase with the sounds emanating from the treadmill. Thus, when the waveform representing sounds emanating from the treadmill 100 exhibit a waveform crest, the cancelling or reducing sound's anti-phase waveform exhibits a trough equal in magnitude to the waveform's crest and vice versa.

The anti-phase waveform emitter 608 represents programmed instructions that, when executed, cause the processing resources 602 to emit the sounds represented by the anti-phase waveform into the environment surrounding the treadmill 100 through a speaker 128. The speaker 128 may be integrated into the treadmill 100, the mobile device 616, or a device positioned nearby the treadmill 100. In some examples, the speakers 128 are part of a home entertainment system, which can simultaneously emit entertainment sounds and the cancelling/reducing sounds. As the sound represented by the anti-phase waveform is emitted into the surrounding environment, the alternating air pressures exhibited by the treadmill's noise are cancelled or reduced by the opposing alternating air pressures induced by the sounds of the anti-phase waveform. As a result, the sounds from the treadmill are either cancelled or reduced.

Further, the memory resources 604 may be part of an installation package. In response to installing the installation package, the programmed instructions of the memory resources 604 may be downloaded from the installation package's source, such as a portable medium, a server, a remote network location, another location, or combinations thereof. Portable memory media that are compatible with the principles described herein include DVDs, CDs, flash memory, portable disks, magnetic disks, optical disks, other forms of portable memory, or combinations thereof. In other examples, the program instructions are already installed. Here, the memory resources 604 can include integrated memory such as a hard drive, a solid state hard drive, or the like.

In some examples, the processing resources 602 and the memory resources 604 are located within the treadmill 100. The memory resources 604 may be part of the treadmill's main memory, caches, registers, non-volatile memory, or elsewhere in their memory hierarchy. Alternatively, the memory resources 604 may be in communication with the processing resources 602 over a network. Further, the data structures, such as the libraries, may be accessed from a remote location over a network connection while the programmed instructions are located locally. Thus, the noise control system 600 may be implemented with the treadmill 100, a mobile device, a user device, a phone, an electronic tablet, a wearable computing device, a head mounted device, a server, a collection of servers, a networked device, a watch, or combinations thereof. Such an implementation may occur through input mechanisms, such as push buttons, touch screen buttons, voice commands, dials, levers, other types of input mechanisms, or combinations thereof.

The noise control system 600 of FIG. 6 may be part of a general purpose computer. However, in alternative examples, the noise control system 600 is part of an application specific integrated circuit.

Figure 7:
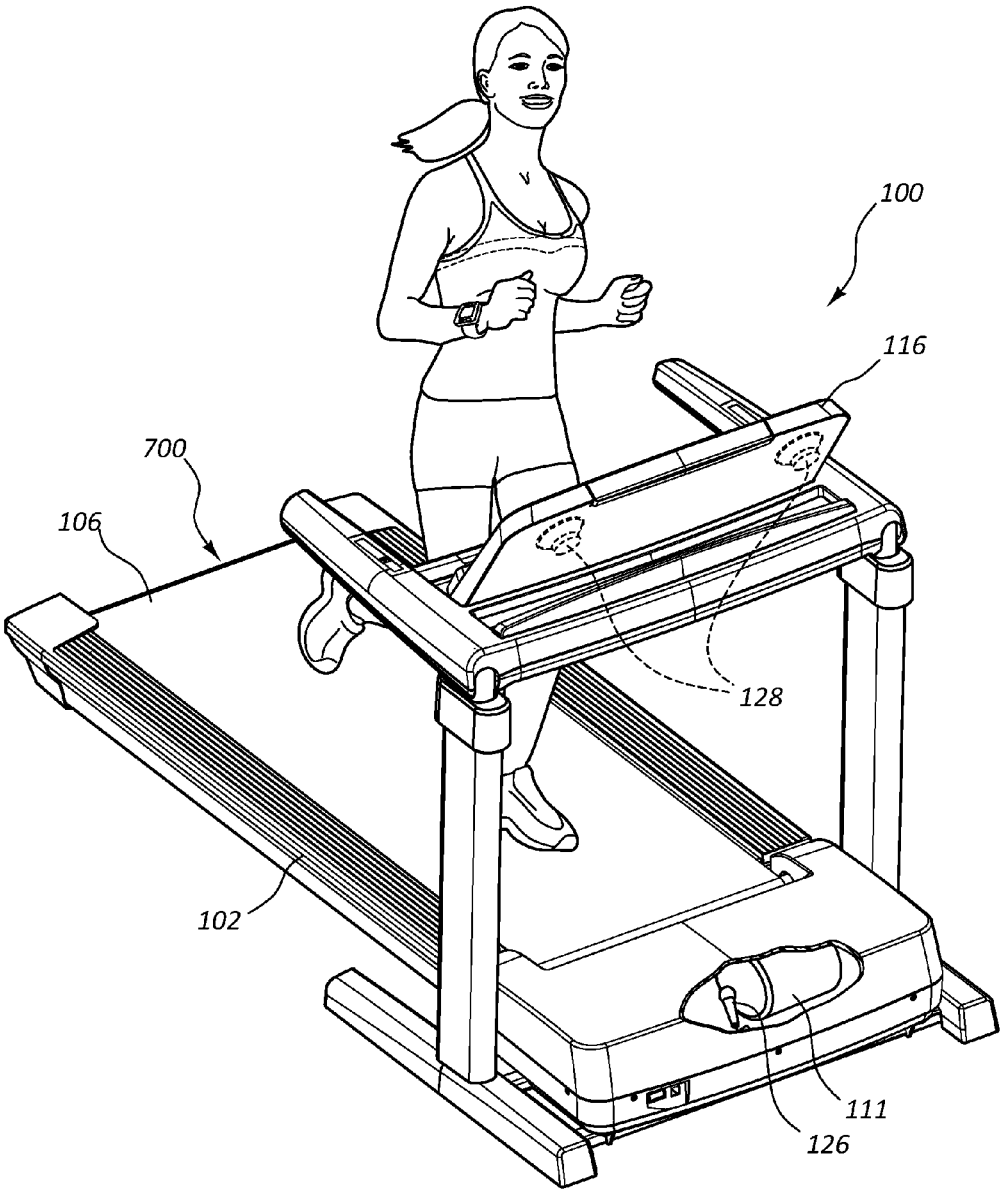
FIG. 7 illustrates a perspective view of an example of a treadmill in accordance with the present disclosure.

FIG. 7 depicts an example of a treadmill 100 with speakers 128 integrated into the control console 116. In this example, the speakers 128 are positioned closer to the user. The speakers 128 may be integrated into the treadmill in any appropriate location. For example, the speakers 128 may be integrated into the control console 116, the running deck 102, the housing 112 of the treadmill's front portion, along the length of the running deck 102, a rear portion 700 of the running deck 102, the treadmill's frame 104, a location nearby the motor 111, either of the frame posts 118, 122, either of the hand holds 120, 124, other locations or components of the treadmill 100, or combinations thereof.

In some examples, multiple microphones 126 are integrated into the treadmill 100 or positioned nearby the treadmill 100. A subset of the microphones 126 may send the recorded sounds to independent processing resources that separately determine the anti-phase waveform for the sounds that are being picked up at those microphone's locations. In such an example, specific speakers 128 may be appropriately positioned to emit different sounds representing the different anti-phase waveforms into the surrounding environment from different angles. In other examples, each of the microphones send the detected sounds to the same processing resources where a single anti-phase waveform is determined. Accordingly, a single sound of the anti-phase waveform is emitted into the surrounding environment from a single speaker 128 or from multiple speakers 128. Even in examples where a single anti-phase waveform is generated, multiple speakers 128 may be positioned at different angles to emit the sounds corresponding to the anti-phase waveform into the surrounding environment.

In some situations, the sounds from the speakers 128 are directed towards specific locations. In some examples, the portions of the treadmill 100 are shaped to enhance certain acoustic characteristics. In such examples, the shape of the treadmill's frame 104, the shape of the control console 116, the shape of another portion of the treadmill 100, or combinations thereof may provide acoustic characteristics that direct the sounds coming from the speakers towards the user's ears. In other examples, the sounds from the speakers 128 are directed towards the noise sources on the treadmill 100. For example, the speakers 128 may be arranged to focus the sounds of the anti-phase waveform towards to the motor 111, the pulleys, other components on the treadmill 100. In such examples, the directional speakers may cause the treadmill's noise to be reduced or cancel within the area that they are emitted into the environment. Thus, the directional speakers can prevent the treadmill's noise from reaching reflection boundaries, such as the walls of the room where the treadmill is located. By cancelling or reducing the treadmill's noise quickly after emanating into the surrounding environment, the calculations for determining the anti-phase waveforms can be simplified because sounds reflections off the walls and other objects in the treadmill's room are minimized or cancelled.

Figure 8:
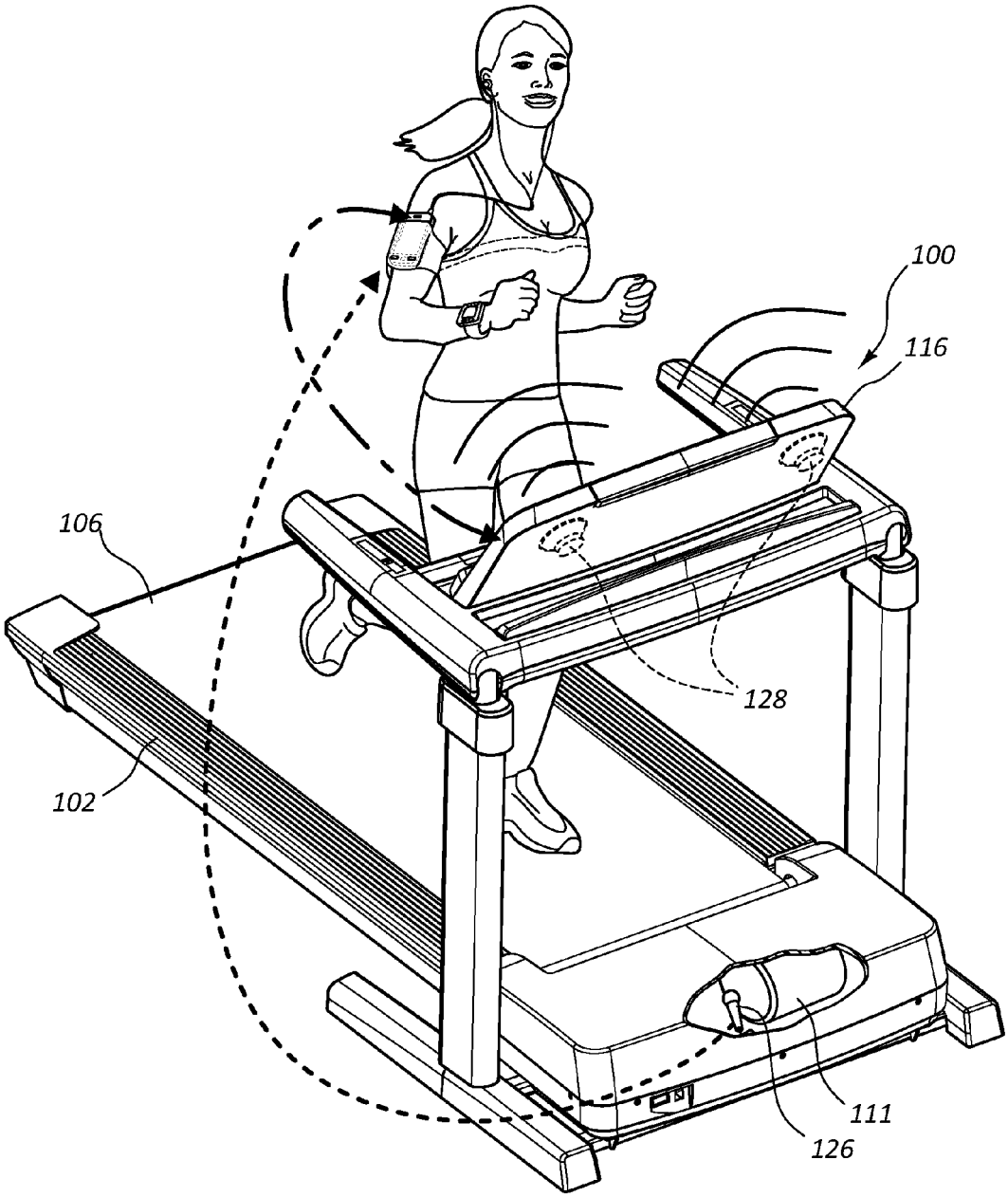
FIG. 8 illustrates a perspective view of an example of a treadmill in accordance with the present disclosure.

FIG. 8 depicts an example of a treadmill 100 in communication with a mobile device 616 worn on the user's arm. In this example, a microphone is incorporated into the mobile device 616. The noise detected by the mobile device 616 is sent to the treadmill's processing resources where the anti-phase waveform is determined. The sounds that correspond with the anti-phase waveform are emitted into the surrounding environment through speakers 128 that are incorporated into the treadmill 100. Any appropriate mobile device 616 may be used. A non-exhaustive list of mobile devices 616 that may be compatible with the principles described in the present disclosure include a smart phone, an electronic tablet, glasses, another type of wearable computing device, another type of mobile device, or combinations thereof.

Any type of wireless communication protocol may be used to communicate between the treadmill 100 and the mobile device 616. For example, the wireless protocols may use a ZigBee protocol, a Z-Wave protocol, a BlueTooth protocol, a Low Energy BlueTooth protocol, a Wi-Fi protocol, a Global System for Mobile Communications (GSM) standard, another standard, or combinations thereof. In other examples, hard wired communication is used to communicate between the treadmill 100 and the mobile device 616.

In some situations, the speakers 128 may be integrated into earphones worn by the user during the workout. In such an example, the sounds may be processed by the processing resources of the treadmill 100, and the anti-phase waveform is sent to the earphones. The earphones may have the capability of emitting a sound that represents the anti-phase waveform into the user's ears. In such an example, the noise coming to the user's ears are cancelled or reduced by sounds of the anti-phase waveform coming from the earphones.

INDUSTRIAL APPLICABILITY

In general, the invention disclosed herein may provide a user with a more enjoyable workout experience on a treadmill. Noise from the treadmill's components can be undesirable for a user, especially when such noise can interfere with the user's ability to hear others talking with him or her or to hear the user's entertainment during the workout. The principles described herein can reduce or cancel the noise generated by the treadmill during the workout, which may improve the user's ability to listen to others, entertainment, music, or other desirable sounds.

In some examples, treadmill has the capability of detecting undesirable sounds that are generated by various components of the treadmill as the treadmill is in operation. Such components may include the treadmill's motor, pulleys, tread belt, other components, or combinations thereof. Such sounds may be detected by microphones incorporated into the any appropriate location of the treadmill, such as the running deck, a housing containing the motor, the frame, the frame posts, the control console, locations in the front portion of the treadmill, locations in the rear portion of the treadmill, other locations on the treadmill, or combinations thereof. In some cases, noises that are generated by the user during the treadmill's operation, such as the pounding of the user's feet against the tread belt as the user runs, may be detected by the microphones.

The detected sounds can be processed to determine the attributes of the sounds. Such sounds can be shifted 180 degree and emitted out into the environment around the treadmill. The original sounds and the shifted sounds can cancel each other out or at least reduce the noise's volumes. In either scenario, the environment in which the user workouts can be improved.

The speakers that emit the sounds representing the anti-phase waveform can be integrated into the treadmill as well. In some examples, the speakers are constructed to direct the sound towards the user. In other examples, the speakers are constructed to direct the sounds representing the anti-phase waveform at specific components of the treadmill. In such examples, the cancelling or reducing sounds can cancel or reduce the sounds emanating from the treadmill in the region where the noise originates. By cancelling or reducing the noise in the region where it originates, the noise may not propagate far from the treadmill, thereby avoiding objects and walls in the room that may cause portions of the noise to reflect back to the user. Thus, by cancelling or reducing the noise within the region where the noise originates, the processing involved in creating the anti-phase waveform may be simplified.

The principles described herein also allow the microphone or speakers to be integrated into devices that are independent of the treadmill. For examples, the microphones or speakers may be integrated into a mobile device that is carried or worn by the user. Such devices may be in hardwired or wireless communication with the treadmill.

Over the course of the workout, the sound attributes of the noise emanating from the treadmill may change. Such changes may occur due to different operational settings of the treadmill. For examples, the noise's attributes may change as the user changes the incline of the running deck, changes the rotational speed of the tread belt, changes other types of operational parameters, or combinations thereof. As the noise's attributes change, the processing resources may detect the change and adjust the anti-phase waveform and its associated cancelling or reducing sounds.

Another benefit of the principles described herein is that the noise cancellation or noise reduction features as described above can give greater freedom to the types of components and features that can be incorporated into the treadmill. For example, less expensive motors that would otherwise generate louder noises may be integrated into the treadmill without the user experiencing the louder noise. Such louder noise may be reduced or cancelled altogether. Thus, the overall cost of the treadmill may be lowered with the incorporation of the features described above.

What is claimed is:

1. A treadmill, comprising:

a running deck comprising a motor arranged to drive movement of a tread belt;

a speaker incorporated into the running deck;

a processor;

memory in electronic communication with the processor; and instructions stored in the memory, the instructions being executable by the processor to:

determine an anti-phase waveform based on waveform attributes of both a noise emitted from the treadmill and a noise caused by treadmill use; and cause a sound of the anti-phase waveform to be emitted into a surrounding environment from a speaker incorporated into the running deck.

2. The treadmill of claim 1, wherein the noise is a motor noise.

3. The treadmill of claim 1, wherein the noise is generated by a user exercising on the running deck.

4. The treadmill of claim 1, further comprising a microphone incorporated into the treadmill.

5. The treadmill of claim 4, wherein the microphone is incorporated into the running deck of the treadmill.

6. The treadmill of claim 1, further comprising a housing covering the motor;

wherein the instructions are further executable by the processor to emit the sound of the anti-phase waveform with the speaker incorporated into the treadmill;

wherein the speaker is incorporated into the housing.

7. The treadmill of claim 1, wherein the sound of the anti-phase waveform is emitted in the surrounding environment with the speaker that is incorporated into the running deck of the treadmill.

8. The treadmill of claim 1, wherein the instructions are further executable by the processor to determine the waveform attributes.

9. The treadmill of claim 1, wherein the instructions are further executable by the processor to receive the waveform attributes from an independent device.

10. The treadmill of claim 1, wherein the instructions are further executable by the processor to distinguish between motor noise and other types of sounds from the treadmill.

11. The treadmill of claim 10, wherein the instructions are further executable by the processor to generate the sound of the anti-phase waveform to cancel the motor noise.

12. The treadmill of claim 1, wherein the sound of the anti-phase waveform has an effect of reducing a volume of the noise.

13. The treadmill of claim 1, wherein the sound of the anti-phase waveform has an effect of cancelling the noise.

14. A treadmill, comprising a running deck comprising a motor arranged to drive movement of a tread belt;

a microphone incorporated into the treadmill;

a speaker incorporated into the running deck;

a processor;

memory in electronic communication with the processor; and instructions stored in the memory, the instructions being executable by the processor to:

determine waveform attributes of a noise emitted from the treadmill and a noise caused by treadmill use and recorded with the microphone;

generate an anti-phase waveform based on waveform; and cause a sound of the anti-phase waveform to be emitted into a surrounding environment with the speaker incorporated into the running deck.

15. The treadmill of claim 14, wherein the microphone is incorporated into the running deck of the treadmill.

16. The treadmill of claim 14, further comprising:

a housing covering the motor;

wherein the speaker is incorporated into the housing.

17. The treadmill of claim 14, wherein the sound of the anti-phase waveform is directed at a component of the treadmill.

18. The treadmill of claim 14, wherein the instructions are further executable by the processor to distinguish between motor noise and other types of sounds from the treadmill.

19. The treadmill of claim 18, wherein the instructions are further executable by the processor to generate the sound of the anti-phase waveform to cancel the motor noise.

20. A treadmill, comprising;

a running deck comprising a motor arranged to drive movement of a tread belt;

a housing covering the motor;

a microphone incorporated into the running deck;

a speaker incorporated into the housing;

a processor;

memory in electronic communication with the processor; and instructions stored in the memory, the instructions being executable by the processor to:

distinguish between motor noise and other noise caused by treadmill use and other types of sounds from a non-treadmill source recorded with the microphone;

determine waveform attributes of the motor noise and other noise caused by treadmill use;

generate an anti-phase waveform based on waveform attributes; and cause a sound of the anti-phase waveform to be emitted into a surrounding environment with the speaker, wherein the anti-phase waveform at least reduces the motor noise and other noise caused by treadmill use.

* * * * *